US005947165A

United States Patent [19]

Speich

[11] Patent Number: 5,947,165

[45] Date of Patent: Sep. 7, 1999

[54] TEXTILE MACHINE WITH DRIVEN THREAD GUIDING MEMBER

[75] Inventor: Francisco Speich, Gipf-Oberfrick, Switzerland

[73] Assignee: Textilma AG, Hergiswil, Switzerland

[21] Appl. No.: 09/011,698

[22] PCT Filed: Aug. 19, 1996

[86] PCT No.: PCT/CH96/00285

§ 371 Date: Feb. 11, 1998

§ 102(e) Date: Feb. 11, 1998

[87] PCT Pub. No.: WO97/08373

PCT Pub. Date: Mar. 6, 1997

[30] Foreign Application Priority Data

Aug. 29, 1995 [DE] Germany ..... 295 13 815

[51] Int. Cl.[6] ..... D03C 3/44; D03C 5/00; D03C 13/00; D04B 27/26

[52] U.S. Cl. ..... 139/456; 66/207

[58] Field of Search ..... 66/207, 205; 139/456

[56] References Cited

U.S. PATENT DOCUMENTS

| | | | |
|---|---|---|---|
| 3,103,953 | 9/1963 | Lauritsen | 139/456 |
| 3,533,450 | 10/1970 | Schilter | 139/456 |
| 3,729,954 | 5/1973 | Ducol | 66/207 |
| 3,794,082 | 2/1974 | Kuster et al. | 139/356 |
| 4,125,135 | 11/1978 | Ebisch | 139/456 |
| 4,145,897 | 3/1979 | Villa | 66/207 |
| 4,653,293 | 3/1987 | Porat | 66/207 |

FOREIGN PATENT DOCUMENTS

| | | |
|---|---|---|
| 159790 | 3/1985 | European Pat. Off. . |
| 531588 | 1/1973 | Germany . |
| 2631175 | 12/1977 | Germany . |
| 2758421 | 6/1978 | Germany . |
| 2939421 | 1/1981 | Germany . |

*Primary Examiner*—Andy Falik

*Attorney, Agent, or Firm*—Hovey, Williams, Timmons & Collins

[57] ABSTRACT

The thread processing device (8) of a textile machine has at least one thread guiding device that moves a thread (4) back and forth between at least two positions (12, 14) by means of a thread guiding member (30, 32, 34). The thread guiding member may be moved in one direction by means of an interlocking drive (28) and in the opposite direction by a frictional engagement drive (36) that acts against the interlocking drive (28). The textile machine is substantially improved by designing the frictional engagement drive (36) as a pneumatic drive with an individual gas chamber (64) that contains a gas volume that may be compressed by the interlocking drive at the working frequency. The gas chamber communicates with a compressed gas source through a non-return valve.

13 Claims, 2 Drawing Sheets

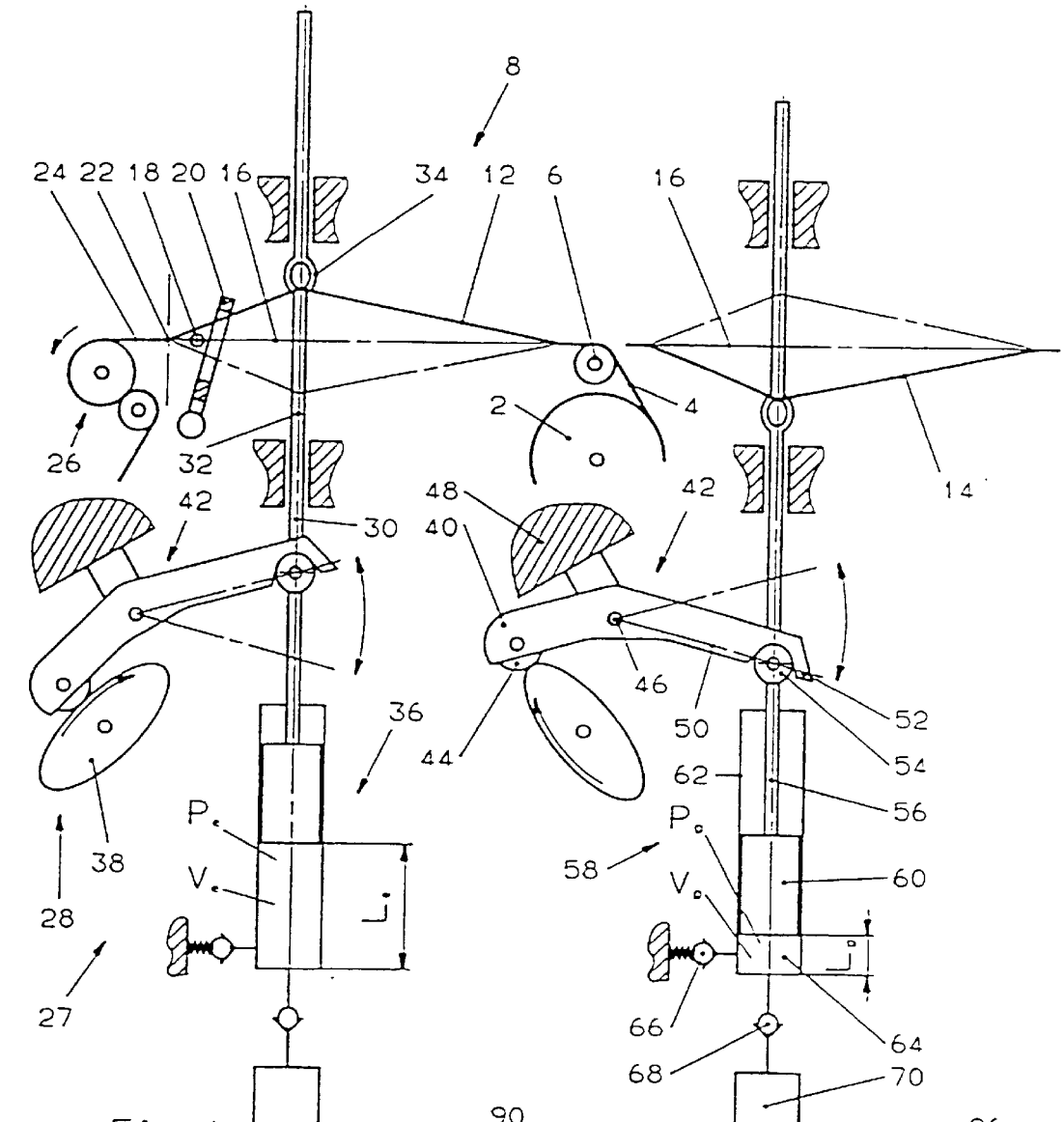
Fig.1
Fig.2
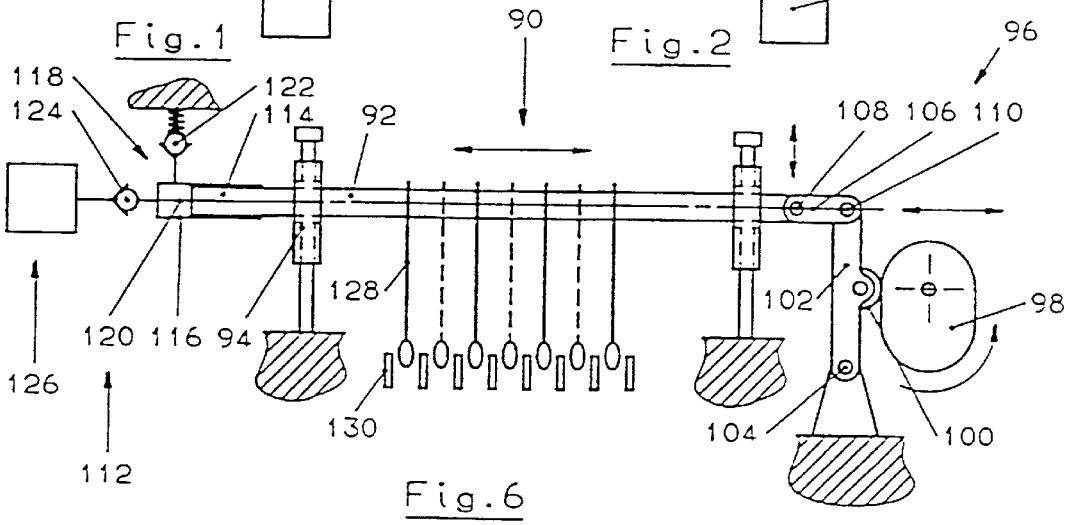
Fig.6

TEXTILE MACHINE WITH DRIVEN THREAD GUIDING MEMBER

BACKGROUND OF THE INVENTION

1. Field of the Invention

The invention concerns a textile machine for the manufacture of textile products from threads with a thread processing device which has at least one thread control device movable in one direction by a form-fitting drive and in the opposite direction by a force-fitting pneumatic drive.

2. Description of the Prior Art

Numerous textile machines are known, for example in the form of weaving looms (U.S. Pat. No. [US-PS] 3 603 351, U.S. Pat. No. [US-PS] 3 695 304, Swiss Patent [CH-PS] 531 588, Europatent [EP-PS] 0 107 099, Europatent [EP-PS] 0 325 547, published unexamined European patent application [EP-OS] 0 363 311, published unexamined German patent application [DE-OS] 31 20 097) or knitting loom (DE-A-27 58 421).

For shed formation, weaving machines comprise thread processing devices that move the warps from a middle shed position into a upper or lower position, in order to open a shed, into which a weft thread is introduced, which is then cast against an edge[1] of the cloth by means of a weaving reed. For shed formation, the most varied devices are used, such as heddle frames and single heddle controls, for the driving of which crank mechanisms, cam plates, cam gears, dobbie looms, jacquard machines or similar being used. In this respect, one distinguishes, as a rule, between two types of drives; a positive drive, such as a crank mechanism, in which driving takes place in both directions of movement according to the form-fitting principle, i.e. in a positive manner, and a negative drive.

With a negative drive, for example cam plates, cam gears, dobbie looms, jacquard machines, and similar, driving takes place in one direction of movement according to the form-fitting principle, i.e. in a positive manner, and in the other direction of movement according to the force-fitting principle, i.e. in a negative manner, for example via extension springs, pressure springs, leaf springs, or torsion springs.

The disadvantage of a positive drive lies in the fact that, in particular with high numbers of revolutions, the mounting areas are punched out and become loose. On the one hand, this causes great noise development, and, on the other hand, inaccuracies, and finally failure of the drive. Such a drive is, for example, not suitable for more than 2,000 revolutions per minute.

With a negative drive, the category, to which the invention herein belongs, driving according to the force-fitting principle takes place by means of extension, pressure, leaf or torsion springs of leaf steel, rubber and synthetic elastomers. Because the force-fitting drive always acts against the form-fitting drive, problems result at higher numbers of revolutions. Thus, for example, in many systems co-vibrations occur that cause the drive parts to get out of control, i.e. the drive parts are no longer situated in a prestressed state with respect to each other. This causes great noise development, failure of the mounting areas, breaking of the springs and ultimately, as a result, complete failure of the thread control. Steel springs are moreover relatively long and heavy, causing a low resonance number of revolutions. With rubber and Elasthan springs, the problems lie in the molecular friction of the material, causing major temperature increases of the springs. Such major temperature increases cause premature aging and loss of the elastic characteristics which, in turn, causes a low resonance number of revolutions, inadequate elastic characteristics, and ultimately their failure. From this results ultimately a drastic reduction in the degree of utility, the efficiency and the production output of such textile machines. It has been found that thread processing devices for shed formation of a weaving loom using the following materials are subject to obvious limitations in the case of force-fitting drives with:

steel extension springs 1,500 rpm max.

steel pressure springs 2,000 rpm max.

rubber extension springs 3,000 rpm max.

Elasthan springs 2,500 rpm max.

Moreover, as a rule, such thread processing machines have a relatively large design volume and, while running, cannot be adjusted to the operating conditions of the textile machine.

From German examined patent application [DE-AS] 26 31 175, a weaving loom of the type mentioned in the introduction is known, in which the retraction for the heddles of a jacquard machine is pneumatically generated. In this design, in each case, the heddles are connected to a piston/cylinder group, the cylinders communicating with a joint large-volume gas chamber so that a retraction force, common to all the heddles and constant over the entire retraction path of the heddle, is available. Individual pneumatic control of every heddle is, therefore, impossible.

SUMMARY OF THE INVENTION

The object of the invention consists in creating a textile machine of the type mentioned in the introduction and having improved characteristics.

In accordance with the invention, the object is achieved by the characterizing features of a textile machine for the manufacture of textile products from threads, which has a thread control device which uses a thread guide device to move at least one thread back and forth. The thread guide device is movable in one direction by a form-fitting drive and in the opposite direction by a force-fitting pneumatic drive acting against the form-fitting drive. The pneumatic drive for the thread guide has a gas volume which is compressible by the form-fitting drive at the operating frequency in an individual first gas chamber.

Because an individual gas volume is allocated to the thread guide device, substantial improvements of the textile machine result, consisting particularly in individual control of each thread guide device. The retraction force can thus be individually adjusted to the requirements of each of the thread guide devices. This is particularly important because the thread guide devices have varying control paths and/or thread qualities to be controlled, to which the retraction force needs to be adjusted, in order to attain optimum results. As a result of the novel design of the thread processing device, in textile machines, such as weaving and knitting looms, considerably higher numbers of revolutions, for example up to 6,000 revolutions per minute become possible, and that with a greatly reduced noise level, i.e. reduced noise development. The high numbers of revolutions become possible because, as a result of the pneumatic design of the force-fitting drive, the critical co-vibrations are considerably higher, namely in the range above 6,000 rpm. Because the critically co-vibrations are very high and higher than the desired rpm range, the maximally required retraction force can be reduced, allowing a lighter-duty design. Additionally, the number of moving parts and their design size can be considerably reduced, causing not only a simpler and more compact design but also reducing the manufacturing costs of such a textile machine, while, nevertheless, increasing the service life of the textile machines before occurrence of intolerable wear. In particular, the pneumatic design of the force-fitting drive also allows adjusting the force of the force-fitting drive to the individual operating conditions even during operation, without being limited thereto.

Advantageous enhancements of the textile machine are described in greater details as follows.

As a rule, it is possible to use any desired gas chamber, the gas volume of which is compressible by means of the form-fitting drive at the operating frequency of the textile machine. Thus, it is, for example, possible to connect the form-fitting drive across a tappet to a membrane of a gas chamber, in order to compress the gas volume by pushing the membrane in against the gas chamber and extraction of same. More advantageous, however, is an enhancement wherein the pneumatic drive has a piston/cylinder group which includes a piston having a first end delimiting a cylinder chamber forming the gas chamber and a second end which is coupled to the form-fitting drive via a piston rod. In this design, the gas chamber can be situated at the side of the piston rod, but it is more advantageous if the gas chamber is arranged on the side of the cylinder oriented away to[2] the piston rod.

Advantageous is an enhancement of the textile machine which includes an operable pressure relief valve connected to the gas chamber. By evacuating the gas chamber, with the textile machine at a standstill, independent of the position of the form-fitting gear, for example a cam gear, the thread control device or the thread can be brought into an initial position. This allows simplified drawing in of the threads into the thread control device, which is particularly advantageous with an embodiment of the thread processing device as a shed formation device. As a result, the thread repair periods and the changeover periods of such a textile machine are considerably reduced.

Also advantageous is an enhancement of the textile machine which includes a pressure control valve connected to the gas chamber, in which, as a result of a pressure control valve on the gas chamber, the maximum pressure cannot be exceeded in the case of an excessive temperature increase or similar.

Particularly advantageous is an enhancement of the textile machine where the gas chamber is connected, preferably via a check valve, to a compressed gas source, and more preferably where the compressed gas source has a control device connected to a control instrument of the textile machine, as a result of which the gas pressure in the gas chamber is adjustable as a function of the operating condition of the textile machine. This allows a completely new operating mode of the textile machine, with operating condition of the textile machine intended to mean not only the individual running phases, such as standstill, startup, high-speed run, crawl speed, and manual operation but also, although not limited thereto, the type of the textile product to be manufactured, such as light or heavy goods, strongly or lightly patterned fabrics, and the type of the thread used, such as fine thread, coarse thread, elastic threads, wrapped threads as well as threads of the most varied materials. Moreover, this shows that the individual components of the textile machine are stressed only to the immediately necessary extent and that the energy requirement of the textile machine can always be adjusted to the least load requirement, allowing to reduce the production costs considerably. This operating mode also makes it possible that based on the need-based reduction of the power of the force-fitting drive, manual operation for adjusting and repair jobs is facilitated. This brings about simplified handling, thus considerably reducing changeover and repair times. Advantageous operating conditions of the textile machine are in accordance with the design of the control device permitting adjustment of the gas pressure in the gas chamber to provide a gas pressure $P_I$ during a product exchange phase I of the textile machine which corresponds to the environmental pressure $P_0$. A gas pressure $P_{II}$ is provided during a start up phase II. This $P_{II}$ pressure is at least as high as a gas pressure $P_{III}$ of a high speed phase. The gas pressure $P_{III}$ during the high speed phase III is lower than or equal to the gas pressure $P_{II}$ during the start up phase II. In addition, a gas pressure $P_{IV}$ is provided during a crawl speed phase IV, which is lower than the gas pressure $P_{III}$ of the high-speed phase III. The control device is further adjustable to provide a gas pressure $P_V$ during a manually operated phase V, which is equal to or lower than the gas pressure $P_{IV}$ of the crawl speed phase. Further, the textile machine is advantageously designed in such a way that, with the gas expanded in the gas chamber, the gas pressure $P_E$ in the gas chamber corresponds to the gas pressure $P_O$ of the compressed gas source. Also, the textile machine is advantageously designed in such a way that a gas pressure $P_K$ which corresponds to the formula $P_K=P_E \cdot V_E/V_K$ is provided in the compressed end state in the gas chamber, where $P_E$ equals the gas pressure of the expanded gas volume of the gas chamber, $V_E$ equals the volume of the gas chamber in the expanded state, and $V_K$ equals the volume of the gas of the gas chamber in the compressed end state. Yet further, the textile machine is advantageously designed in such a way that the gas pressure $P_K$ in the compressed end state has a value such that $P_K \leqq 100 \cdot P_E$.

In certain cases, an enhancement of the textile machine may have a piston/cylinder group having a cylinder part which is situated on the second side of the piston and which is also designed as a second gas chamber. This cylinder part forming the second gas chamber is connected to a pressure control device in such a way that the gas pressure P of the second gas chamber, which can support the function of the first gas chamber and/or act to oppose it, not only its function can be improved but the co-vibration response of the pneumatic drive can potentially also be affected in an even more positive manner. By means of the second gas chamber and the control device, potentially, a positive control of the thread processing device can also be achieved if, for instance, as a result of applying a controllable excess pressure in the second gas chamber, a thread control device no longer follows the force-fitting drive[3] for example a warp thread remains in the lower position and, as a result, contributes to the pattern formation of the textile product to be manufactured.

The textile machine may be designed as an the enhancement of the textile machine as a weaving loom, with the shed formation device being provided with a form-fitting pneumatic drive. In particular in ribbon weaving looms, it is, however, also imaginable to have the drive of a weft insertion needle equipped with such a force-fitting pneumatic drive.

The textile machine may also be designed as an enhancement of the textile machine as a knitting loom, with the force-fitting pneumatic drive is assigned to a thread guide rod and more specifically to a weft guide rod. If a knitting loom comprises several thread guide rods, such a force-fitting pneumatic drive can be assigned to each thread guide rod.

As gas, as a rule, air will be used. But it is also imaginable that, by using other gases, a specifically matched operating response can be achieved.

BRIEF DESCRIPTION OF THE DRAWINGS

Sample embodiments of the invention are described in detail hereinafter based on the drawings showing:

FIG. 1 is a side elevational view in partial cross-section of a weaving loom with a thread processing device for shed formation in the upper position of the warp;

FIG. 2 is a side elevational view of the weaving loom in FIG. 1 in the lower position of the warp;

FIG. 6 is a front elevational view of the thread processing device of a knitting loom with a thread guide rod.

DESCRIPTION OF THE PREFERRED EMBODIMENTS

Figure 4:
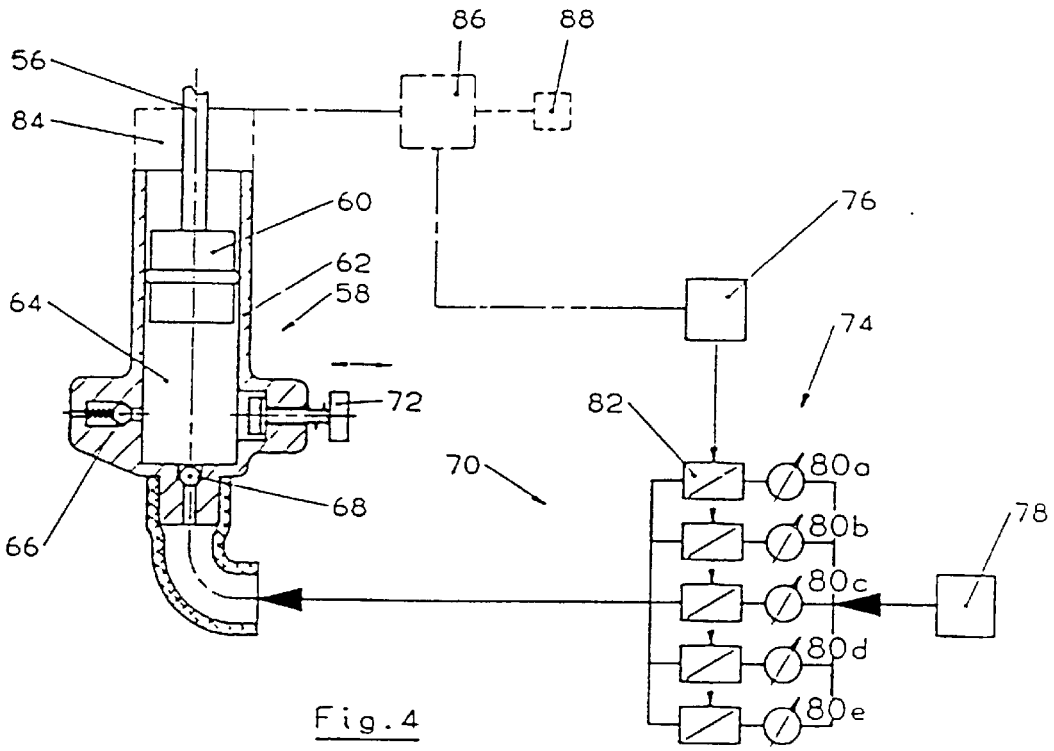
FIG. 4 is an enlarged, fragmentary vertical cross-sectional view showing the force-fitting pneumatic drive of the shed formation device of the weaving loom of FIGS. 1 and 2 with a compressed gas source.

FIGS. 1 and 2 describe a textile machine designed as a weaving loom, the basic design of which corresponds for example to the one of weaving loom of US-PS 3 603 351 or CH-PS 531 588 or EP-PS 0 107 099. The weaving loom comprises a loom beam 2, from which warps 4 arrive, via a back rail 6, in the area of a thread processing device 8, which is designed as a shed formation device, in order to deflect the warps 4 from the upper shed position 12 into the lower shed position 14 or from the lower shed position 14 to the upper shed position 12. As a result, a shed 16 is opened, into which a weft 18 is introduced and cast, by means of a weaving reed 20, against a selvage 22 of the cloth. The textile product 24 manufactured in this manner, i.e. the fabric, is taken off via a fabric takeoff 26.

The thread processing device 8 for the production of the shed, comprises a thread control device 27 with a form-fitting drive 28, which, as a thread guide device, moves a heddle frame 30 with a heddle 32 and a heddle eye 34 into a lower position, while a force-fitting pneumatic drive 36 opposes this action and moves the shaft edge 30 into the upper position. The form-fitting drive 28 comprises a driven cam plate 38, with which cooperates an arm 40 of a dual-arm lever 42 across a roller 44. The dual-arm lever 42 is pivotally supported, via a pivot point 46, by machine frame 48. The second arm 50 of the dual-arm lever 42 interacts, via a fork 42, with a cam 54, which is attached to a heddle frame 30. This cam 54 is also engaged by a piston rod 56 of a piston cylinder group 58 of the force-fitting pneumatic drive 36. Piston rod 56 is connected to a piston 60, which is guided to move up and down in a cylinder 62. On the side averted from piston rod 56 of piston 60, the piston/cylinder group forms a gas chamber 64, to which are connected a pressure control valve 66 for limitation of the maximum pressure and, via a check valve 68, a compressed gas source 70. As particularly evident from FIG. 4, gas chamber 64 may be additionally provided with a manually activatable pressure relief valve 72. FIG. 1 shows the force-fitting pneumatic drive 36 with an expanded gas volume $V_E$ at pressure $P_E$ in gas chamber 64, when the heddle frame takes the upper position. FIG. 2 shows the form-fitting pneumatic drive 36 with a compressed gas volume $V_K$ and the pressure $P_K$, when the heddle frame 30 takes the lower position.

Figure 3:
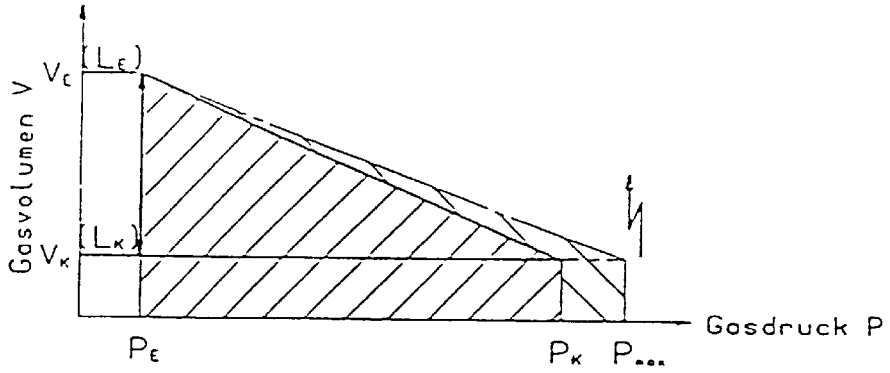
FIG. 3 is a graphical representation of the dependence of the gas pressure on the gas volume of the gas chamber of FIGS. 1 and 2.

The diagram of FIG. 3 shows the dependence of gas pressure P on gas volume V and the corresponding position L of piston 60 in cylinder 62. When the piston is displaced from the expanded position $L_E$ to the compression position $L_K$, gas volume V changes from the expanded state $V_E$ to the compressed volume $V_K$, while gas pressure $P_E$ increases from the expanded state to gas pressure $P_K$ in the compressed state. In the diagram of FIG. 3, the maximum pressure$^I$ $P_{max}$ given by pressure control valve 66 is also shown, during which the pressure control valve 66 opens. The force-fitting pneumatic drive 36 is expediently designed in such a way that gas pressure $P_K$ in the compressed state of the gas chamber is:

$$P_K = \frac{P_E \cdot V_E}{V_K}$$

Preferably, the gas pressure $P_K$ is:

$$P_K \leqq 100 \cdot P_E$$

In FIG. 4, the force-fitting pneumatic drive 36 of FIGS. 1 and 2 is illustrated in detail, with compressed gas source 70 additionally comprising a control device 74, which is connected to a control instrument 76 of the weaving loom. Compressed gas source 70 comprises a compressor 78, which supplies compressed gas, preferably air, to control device 74. The latter comprises various pressure reduction valves 80*a–e*, which correspond to the different operating conditions I–V of the weaving loom. Control instrument 76 controls opening valves 82 downstream from the pressure reduction valves 80*a–e*, in order to allow compressor 78, via the selected pressure reduction valve 80*a–e*, to communicate with the piston/cylinder group 58.

Figure 5:
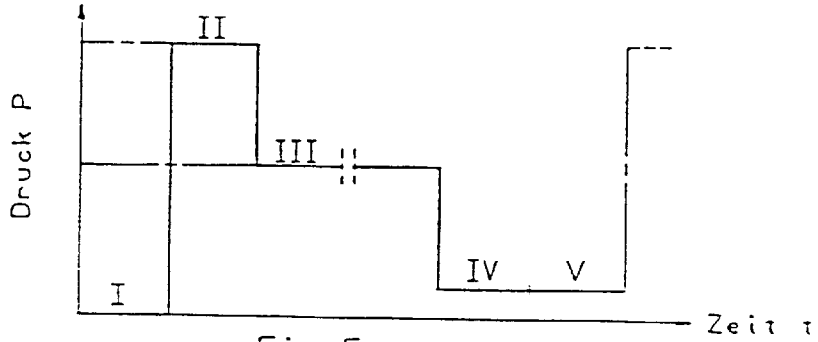
FIG. 5 is a diagram of the dependence of the gas pressure on the operating condition of the weaving loom.

FIG. 5 then shows the development of the pressure that the compressed gas source 70 feeds into gas chamber 64 as a function of various operating phases of the weaving loom. In the product exchange phase I, gas pressure $P_I$ corresponds to the environmental atmospheric pressure, hence is practically zero. During startup phase II, gas pressure $P_{II}$ is greatest and then drops again to gas pressure $P_{III}$ during high-speed run phase III. When the weaving loom is operated in crawl speed phase IV, gas pressure $P_{IV}$ decreases further. In the manual operation phase V, gas pressure $P_V$ may be equal to or lower than gas pressure $P_{IV}$ of crawl speed phase IV.

Normally the force-fitting pneumatic drive 36 operates only against the form-fitting drive 28, i.e. cylinder 62 is open on the side oriented toward piston rod 56 and is subject to environmental pressure $P_0$. In FIG. 4, an additional enhancement is indicated in dots and dashes, the side of piston 60 situated opposite gas chamber 64 also being provided with a gas chamber 84, i.e. being closed and connected to a pressure control device 86, which has a compressor be enhanced in such a way that this second gas chamber 84 supports the function of the first gas chamber 64 and/or opposes it. As a result, a more subtle adjustment and control of the force-fitting pneumatic drive 36 is possible. The pressure control device can potentially also be connected with control instrument 76 of the weaving loom and enhanced in such a way that the pressure in second gas chamber 64 is periodically greater than the gas pressure in the first gas chamber 64, as a result, allowing heddle frame 30 to be kept in the lower position and consequently no longer following the form-fitting drive 28. As a result, a pattern-based control of the heddle frame is possible.

FIG. 6 shows a thread processing device 90 of a knitting loom, for example of a warp knitting loom, in particular of a crochet galloon machine, the basic design of which is evident from German unexamined patent application [DE-OS] 27 58 421, for instance. In FIG. 6, a guide rod 92 for example for a weft thread (not illustrated in detail) is shown. Guide rod 92 is guided in carriers 94 to move up and down and to be longitudinally movable and, on one side, interacts with a form-fitting drive 96, which has a driven revolving cam plate 98 that acts on a roller 100, which is attached to an oscillating lever 102. Oscillating lever 102 is pivotally supported by machine frame 104 and cooperates, on its side averted from machine frame 104, via a coupling link 106, with guide rod 92. Coupling link 106 is, on the one hand, connected, via a joint 110, to oscillating lever 102 and, on the other hand, via a second joint 108, with guide rod 92 so that the latter can carry out a movement going up and down. The other end of guide rod 92 is connected to a force-fitting pneumatic drive 112, with guide rod 92 being designed as a piston 114, which plunges into a cylinder 116 of a piston/cylinder group 118. Inside cylinder 116, a gas chamber 120 is thus formed, to which are connected, on the one hand, a pressure control valve 122 and, on the other hand, via a check valve 124, a compressed gas source 126. Cylinder 116 can, in the area of gas chamber 120, be additionally provided with a pressure relief valve, that can be manually operated, in analogy to pressure relief valve 72 of FIG. 4. To the guide bar, thread guides 128 are attached, which can be moved back and forth between the position in solid lines and that in dashed line and interact with weaving needles 130, in order to insert a weft thread (not illustrated in detail) between at least two weaving needles 130. The path of the movement may also run across two or more weaving needles.

Control of the knitting loom in accordance with FIG. 6 can take place in accordance with analogous principles, such as the control of the weaving loom in accordance with the FIGS. 1 through 5.

I claim:

1. A textile machine for the manufacture of textile products from threads, with a thread processing device which has at least one thread control device which moves at least one thread back and forth at an operating frequency by means of a thread guide device via at least two positions, the thread guide device being moveable in one direction of movement by means of a form-fitting drive and in the opposite direction of movement by means of a force-fitting pneumatic drive acting against the form-fitting drive, wherein the pneumatic drive for the thread guide has a gas volume compressible by the form-fitting drive at the operating frequency in an individual first gas chamber.

2. A textile machine in accordance with claim 1, wherein the pneumatic drive has a piston/cylinder group that comprises a piston which, has a first end delimiting a cylinder chamber forming the gas chamber and a second end is coupled, via a piston rod to the form-fitting drive.

3. A textile machine in accordance with claim 1 wherein an operable pressure relief valve is connected to the gas chamber.

4. A textile machine in accordance with claim 2, wherein the first gas chamber has a function acting on the form-fitting drive via the piston rod, and the piston/cylinder group has a cylinder part which is situated at the second end of the piston forming a second gas chamber and is connected to a pressure control device in such a way that the gas pressure P in the second gas chamber supports the function of the first gas chamber and/or counteracts it.

5. A textile machine in accordance with claim 1, wherein a pressure control valve is connected to the gas chamber.

6. A textile machine in accordance with claim 1, wherein the gas chamber is connected to a compressed gas source.

7. A textile machine in accordance with claim 6, wherein the compressed gas source has a control device which is connected to a control instrument of the textile machine by means of which the gas pressure in the gas chamber can be adjusted as a function of the operating frequency of the textile machine.

8. A textile machine in accordance with claim 7, wherein the gas pressure P in the gas chamber is adjustable by the control device to provide a gas pressure $P_I$ during a product exchange phase I of the textile machine, which gas pressure $P_I$ corresponds to the environmental pressure $P_0$, a gas pressure $P_{II}$ during a start up phase II, which is at least as high as a gas pressure $P_{III}$ of a high-speed phase, the gas pressure $P_{III}$ during the high-speed phase III, which is lower than or equal to the gas pressure $P_{II}$ of said start up phase II, a gas pressure $P_{IV}$ during a crawl speed phase IV, which is lower than the gas pressure $P_{III}$ of the high-speed phase III; and a gas pressure $P_V$ during a manually operated phase V, which is equal to or lower than the gas pressure $P_{IV}$ of the crawl speed phase.

9. A textile machine in accordance with claim 6, wherein the gas pressure P in the gas chamber is adjustable by the control device whereby the gas pressure $P_E$ in the gas chamber corresponds to the gas pressure $P_Q$ of the compressed gas source when the gas is expanded in the gas chamber.

10. A textile machine in accordance with claim 9, wherein the gas pressure P in the gas chamber is adjustable by the control device whereby a gas pressure $P_K$ provided in the gas chamber in the compressed end state corresponds to the following formula:

$$P_K = \frac{P_E \cdot V_E}{V_K}$$

where:

$P_E$ =gas pressure of the expanded gas volume of the gas chamber, $V_E$ =volume of the gas of the gas chamber in the expanded state, and $V_K$ =volume of the gas of the gas chamber in the compressed end state.

11. A textile machine in accordance with claim 10, wherein the gas pressure P in the gas chamber is adjustable by the control device such that the gas pressure $P_K$ in the compressed end state has a value:

$$P_K \leqq 100 \cdot P_E.$$

12. A textile machine in accordance with claim 1, wherein the textile machine is designed as a weaving loom having a shed formation device with at least the shed formation device being provided with the force-fitting pneumatic drive.

13. A textile machine in accordance with claim 1, wherein the textile machine is a warp knitting loom having at least one weft guide rod provided with the force-fitting pneumatic drive.

* * * * *